US007168700B2

(12) United States Patent
Skadow et al.

(10) Patent No.: US 7,168,700 B2
(45) Date of Patent: Jan. 30, 2007

(54) SHEET FEEDER APPARATUS AND METHOD WITH THROUGHPUT CONTROL

(75) Inventors: Herman G. Skadow, Park Ridge, IL (US); Stephen R. Archer, Des Plaines, IL (US); Thomas D. Para, Elmwood Park, IL (US); Ramesh Pankajakshan, Chicago, IL (US); Richard M. Szewczyk, Buffalo Grove, IL (US)

(73) Assignee: Bowe Bell + Howell Company, Durham, NC (US)

( * ) Notice: Subject to any disclaimer, the term of this patent is extended or adjusted under 35 U.S.C. 154(b) by 0 days.

(21) Appl. No.: 10/683,254

(22) Filed: Oct. 10, 2003

(65) Prior Publication Data

US 2004/0056410 A1 Mar. 25, 2004

(51) Int. Cl.
*B65H 5/34* (2006.01)

(52) U.S. Cl. ..... 271/270; 271/202; 271/256; 271/265.01; 271/266

(58) Field of Classification Search ..... 271/270, 271/176, 69, 202, 256, 265.01, 266
See application file for complete search history.

(56) References Cited

U.S. PATENT DOCUMENTS 4,077,620 A * 3/1978 Frank et al. ..... 271/10.03
4,171,130 A * 10/1979 Jeschke et al. ..... 271/10.03
4,331,328 A * 5/1982 Fasig ..... 271/270
4,451,027 A * 5/1984 Alper ..... 271/10.02
4,541,624 A 9/1985 Sasage et al.
4,787,620 A * 11/1988 Goldkuhle ..... 271/111
4,978,114 A 12/1990 Hollbrook
5,056,771 A * 10/1991 Beck et al. ..... 271/114
5,074,540 A 12/1991 Belec et al.
5,105,363 A * 4/1992 Dragon et al. ..... 700/225
5,121,915 A * 6/1992 Duncan et al. ..... 271/111
5,163,666 A 11/1992 Kuo
5,197,726 A * 3/1993 Nogami ..... 271/110
5,238,236 A 8/1993 Belec et al.
5,253,860 A * 10/1993 Hirose et al. ..... 271/176
5,290,022 A 3/1994 Sabatier et al.
5,295,677 A * 3/1994 Hutner ..... 271/110
5,423,527 A * 6/1995 Tranquilla ..... 271/10.02
5,456,457 A 10/1995 Kerstein et al.
5,564,689 A 10/1996 Fukube
5,575,466 A * 11/1996 Tranquilla ..... 271/10.03
5,575,469 A * 11/1996 Coombs et al. ..... 271/270
5,602,571 A * 2/1997 Suda et al. ..... 346/134
5,692,741 A * 12/1997 Nakamura et al. ..... 271/10.03

(Continued)

FOREIGN PATENT DOCUMENTS

EP 0 060 596 A1 9/1982
JP A-10 231 035 2/1997
WO WO-A-92/164444 10/1992

*Primary Examiner*—Patrick Mackey
*Assistant Examiner*—Matthew J. Kohner
(74) *Attorney, Agent, or Firm*—McDermott Will & Emery LLP

(57) ABSTRACT

A sheet feeder apparatus and method with throughput control. By varying the speed at which sheets are fed from a supply, the sheet feeder apparatus and method assures that the throughput capacity of a downstream operation is never exceeded. Speed is varied based upon the length of the sheets being fed. Furthermore, the sheet feeder apparatus can have worn components replaced quickly and by operators of minimal skill level.

19 Claims, 7 Drawing Sheets

U.S. PATENT DOCUMENTS 5,692,742 A * 12/1997 Tranquilla ..... 271/10.03
5,813,327 A 9/1998 Freeman et al.
5,833,230 A 11/1998 Nakagawa et al.
5,941,517 A 8/1999 Heiber et al.
5,971,389 A 10/1999 Golicz et al.
6,076,821 A * 6/2000 Embry et al. ..... 271/10.01
6,126,160 A * 10/2000 Ebert et al. ..... 271/10.03
6,199,854 B1 * 3/2001 Tranquilla et al. ..... 271/34
6,224,049 B1 * 5/2001 Hosking et al. ..... 271/10.03
6,354,583 B1 * 3/2002 Skadow et al. ..... 271/10.03
6,378,859 B1 * 4/2002 Lubben et al. ..... 271/10.03
6,505,832 B2 * 1/2003 Moore et al. ..... 271/265.01
6,550,764 B2 * 4/2003 Wilson et al. ..... 271/270
6,554,275 B1 * 4/2003 Tranquilla ..... 271/259
6,572,096 B1 * 6/2003 Johnson et al. ..... 271/25
6,572,103 B1 * 6/2003 Tranquilla ..... 271/265.02
6,644,659 B2 * 11/2003 Skadow et al. ..... 271/265.02
6,655,677 B2 * 12/2003 Marshall et al. ..... 271/10.03
6,685,184 B2 * 2/2004 Tufekci et al. ..... 271/270
6,702,274 B1 * 3/2004 Otsuka ..... 271/10.01
6,786,483 B2 * 9/2004 Nishimura et al. ..... 271/270
6,802,504 B2 * 10/2004 DePoi et al. ..... 271/259
2003/0062671 A1 * 4/2003 Yasui et al. ..... 271/270
2004/0119224 A1 * 6/2004 Otsuka ..... 271/10.03

* cited by examiner

SHEET FEEDER APPARATUS AND METHOD WITH THROUGHPUT CONTROL

TECHNICAL FIELD

The present invention relates generally to sheet feeder apparatuses, and more particularly to improvements for sheet feeders that are used to separate single sheets from a supply of sheets and then feed the separated sheets downstream for further operations, such as reading indicia off the sheets and then sorting the sheets according to the read indicia.

BACKGROUND ART

As recognized by those skilled in the art, operating sheet feeders at or near their maximum capability is critical for optimizing output and throughput. However, what may be maximum capability for one type of sheet may no longer be optimum for a second type of sheet. For example, at a given speed, the smaller the sheets, the more the sheets will pass a predetermined point per unit time. At some point, the number of sheets passing that point per unit time will exceed the rate at which the sheets can be processed downstream, causing errors, misfeeds, or other unwanted overload conditions.

As sheet feeders should be able to handle multiple sheet sizes on the fly to achieve maximum flexibility and cost control, a structure and control system for handling sheets of various types is required that will not overload a downstream operation.

Accordingly, there is room for improvement within the art of sheet feeder apparatuses and methods.

DISCLOSURE OF THE INVENTION

It is an object of the invention to provide a sheet feeder apparatus and method that can be continuously operated at or near maximum capability.

It is a further object of the invention to provide a sheet feeder apparatus and method that can be continuously operated at or near maximum capability while feeding documents of differing length.

It is yet a further object of the invention to provide a sheet feeder apparatus and method wherein worn components can be replaced quickly and by operators of minimal skill level.

These and other objects of the invention are achieved by a sheet feeder, comprising: a magazine subassembly for supporting a supply of sheets to be fed down a sheet path and feeding the supply of sheets towards the sheet path; a feed subassembly positioned on one side of the sheet path and for separating the outermost sheet from the supply of sheets; a singulator subassembly, spaced across the sheet path from the feed subassembly, and for assuring that only the outermost sheet of the supply of sheets is separated from the supply of sheets; a transport subassembly for feeding the separated outermost sheet downstream for further processing; and a control system, the control system determining the size of the sheet separated from the magazine subassembly and adjusting the speed of the feed subassembly and holding the speed for predetermined durations to provide for a predetermined sheet gap size between the separated sheet and the next sheet to be separated dependent upon the length of the separated sheet.

Also in accordance with this invention, a method for feeding sheets comprises the steps of: providing a supply of sheets; sequentially separating a sheet from the supply of sheets; feeding the separated sheet downstream; and controlling the size of a gap between sequential sheets based upon the length of the sheets.

A method for providing a singulator subassembly in a sheet feeder is also provided and comprises the steps of: providing a drive shaft; providing one or more self-contained pre-constructed removable conveyor assemblies; placing on or more of the self-contained pre-constructed removable conveyor assemblies on the drive shaft; and placing a removable end cap on the drive shaft to secure the one or more self-contained pre-constructed removable conveyor assemblies in position.

Some of the objects of the invention having been stated hereinabove, other objects will become evident as the description proceeds, when taken in connection with the accompanying drawings as best described hereinbelow.

DETAILED DESCRIPTION OF THE INVENTION

With reference to the attached figures of drawings, a sheet feeder with throughput control and method that meets and achieves the various objects of the invention set forth above will be described with respect to an exemplary non-limiting embodiment.

Figure 1A:
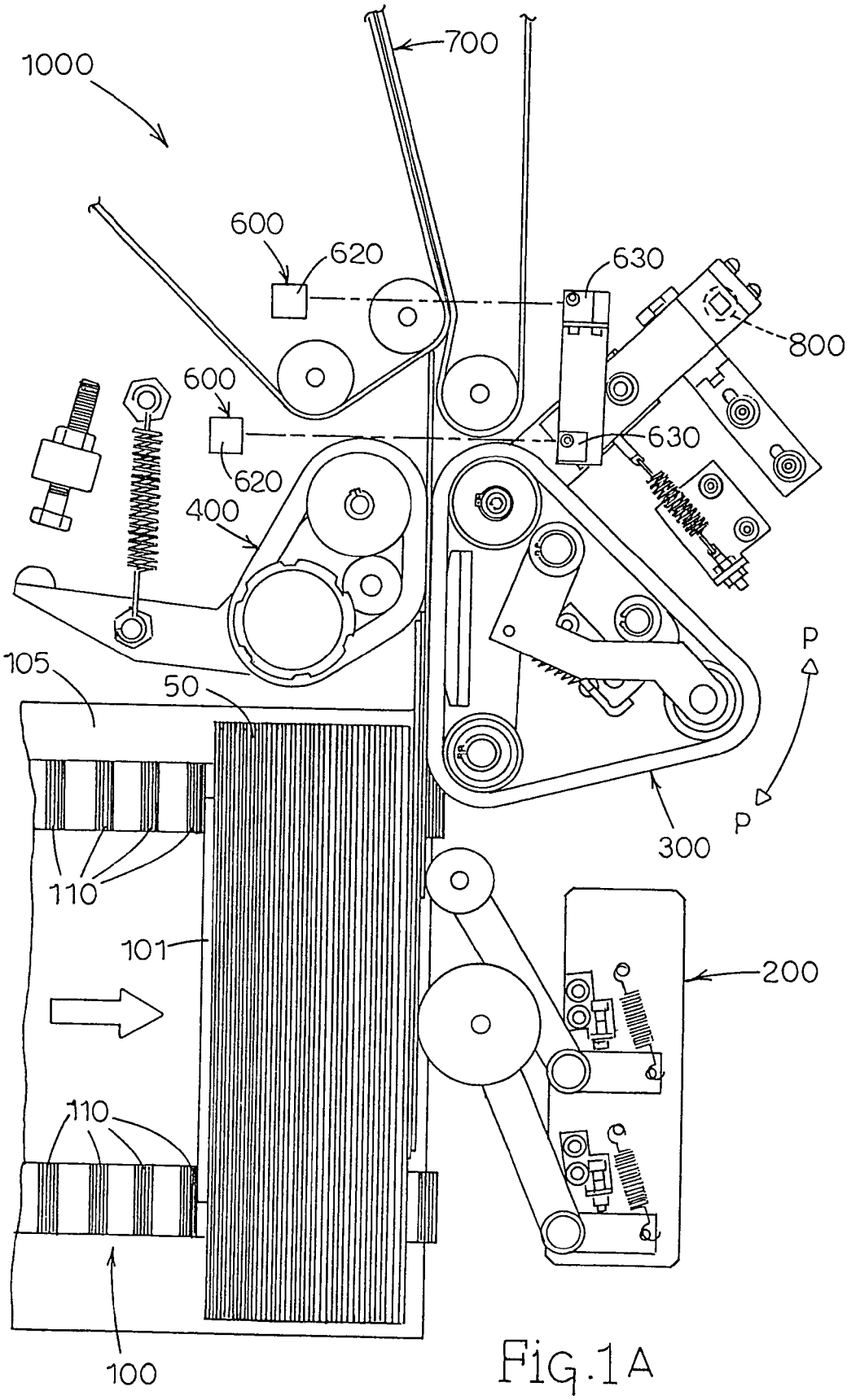
FIG. 1A is a plan view of an exemplary embodiment of a sheet feeder according to the present invention.

FIG. 1A is a plan view of an exemplary embodiment of a sheet feeder 1000 according to the invention. Sheet feeder 1000 comprises multiple subassemblies, namely: magazine subassembly 100, pressure roller subassembly 200, feeder subassembly 300, singulator subassembly 400, photo sensors 600, transport subassembly 700, and Hall-effect sensor switch subassembly 800.

While each subassembly will be described in greater detail below, first a general overview of the structure and operation of sheet feeder 1000 will be provided. Magazine 100 is provided with a supply of on-edge sheet material 50, typically either a sorted (by size) or mixed supply of sheets, e.g., envelopes or postcards of various sizes. Switch S (FIG. 1B) is associated with magazine 100 and has two settings: "cards", used with a supply of card length sheet material only and "letters", used with either a supply of letter length sheet material only or a mixed supply of letter and card length sheet material (also known as a "mixed deck"). In more general language, the "cards" setting is used with sheets only smaller than a predetermined length and the "letter" setting is used with a supply of sheets containing at least one letter sized sheet (i.e., sheets either larger or smaller than the predetermined length). In the instant invention, the predetermined length is about 6 inches, or the length of a standard postcard.

Magazine belts 110, which are made from a high friction material and have timing teeth along the outside surface thereof, are moved by magazine motor 190, which is controlled through DC controller 191 (FIG. 1B), to feed the sheet supply towards and against pressure roller subassembly 200 with assistance from a paddle 101 that rests in the gap between timing teeth, which limits the amount of deflection and deformation of sheet material. The vertically disposed paddle 101 is used to hold the on-edge material in magazine 100 in the proper on-edge configuration. The speed at which magazine motor 190 moves the on-edge sheet material downstream towards the sheet path and towards pressure roller assembly 200 is controlled by switch S. When switch S is set to "card" mode, motor 190 moves the on-edge sheet material downstream at a slower speed than when switch S is in "letter" mode. This is because card material is thinner than letter material and, therefore, per unit time, less cards are fed out of magazine 100 than would be the case for letter material. Accordingly, card material needs to be replenished at a slower rate than letter material and motor 190's speed is set as such.

A few of the outermost sheets in magazine 100 are then fanned out by a combination of feeder assembly 300 and slowly rotating pivoting singulator subassembly 400. The actual outermost of the fanned out sheets is removed from magazine 100 by the faster rotating pivoting feeder subassembly 300 while the other fanned out sheets are retained in the magazine 100 by singulator subassembly 400. Accordingly, singulator 400 assures only the outermost sheet and hence only one sheet at a time is feed downstream. As sheets are fed out of magazine 100 one at a time and if at a rate faster than magazine 100 moves the sheet supply towards feeder subassembly 300, the pressure the sheets apply against feeder subassembly 300 decreases. This decrease is measured by using Hall Effect sensor assembly 800 to measure the amount of pivotal deflection of feeder subassembly 300. Dependent upon the amount of deflection of feeder assembly 300, a varying voltage signal is sent to controller C indicating the magazine 100 needs to feed more sheet material downstream towards feeder assembly 300. Controller C then sends a voltage control signal dependent upon the signal received from the sensor (i.e., the amount of deflection of feeder subassembly 300) to the motor 190 (FIG. 1B) that drives magazine 100. Each signal corresponds to a predetermined magazine 100 feed speed associated with the amount of deflection of feeder subassembly 300 detected by the sensor. Motor 190 operates until the pressure against the feed subassembly 300 returns to the acceptable predetermined level as measured by the sensor.

As the sheets are singulated out of magazine 100, sensor subassembly 600 is used to generate signals used by controller C to determine the size (length) of the singulated sheet. This size determination step is needed because, as will be described below, the between sheet spacing, i.e., gap size, must be adjusted based upon the size of the sheets being fed. Accordingly, by using these photo sensor signals, controller C calculates the mail piece length along with its appropriate gap and the appropriate separation speed for the next sheet is set. Therefore, the proper between sheet spacing, i.e., gap size, is maintained and the sheets are fed downstream by transport belt subassembly 700 at a constant speed acceptable for conducting downstream operations but with a varying gap dependent upon the sizes of sequential sheets. A larger gap is introduced if the sheet is determined to be less than 6 inches long verses the smaller gap that is introduced if the sheet is determined to be more than 6 inches long.

In the instant invention, it is contemplated that the downstream operation will comprise reading printed indicia indicative of the zip code of the mail destination off the sheet material and then sorting the sheet material by the printed indicia into a number of individual sorting bins (not shown). To date, some such indicia readers have a maximum number of sheets that they can read per unit time. Furthermore, such readers operate so as to read the indicia at one particular throughput speed, equal to about the speed of transport subassembly 700. It can be seen that by varying the spacing between sheets being fed to transport subassembly 700, sheet feeder 1000 can assure that the reader is never overloaded while not having to vary the speed of transport subassembly 700 away from the speed needed by the indicia reader to properly operate.

Having described the general structure and operation of sheet feeder 1000, each of its major subassemblies and operation will now be described in greater detail.

Figure 1B:
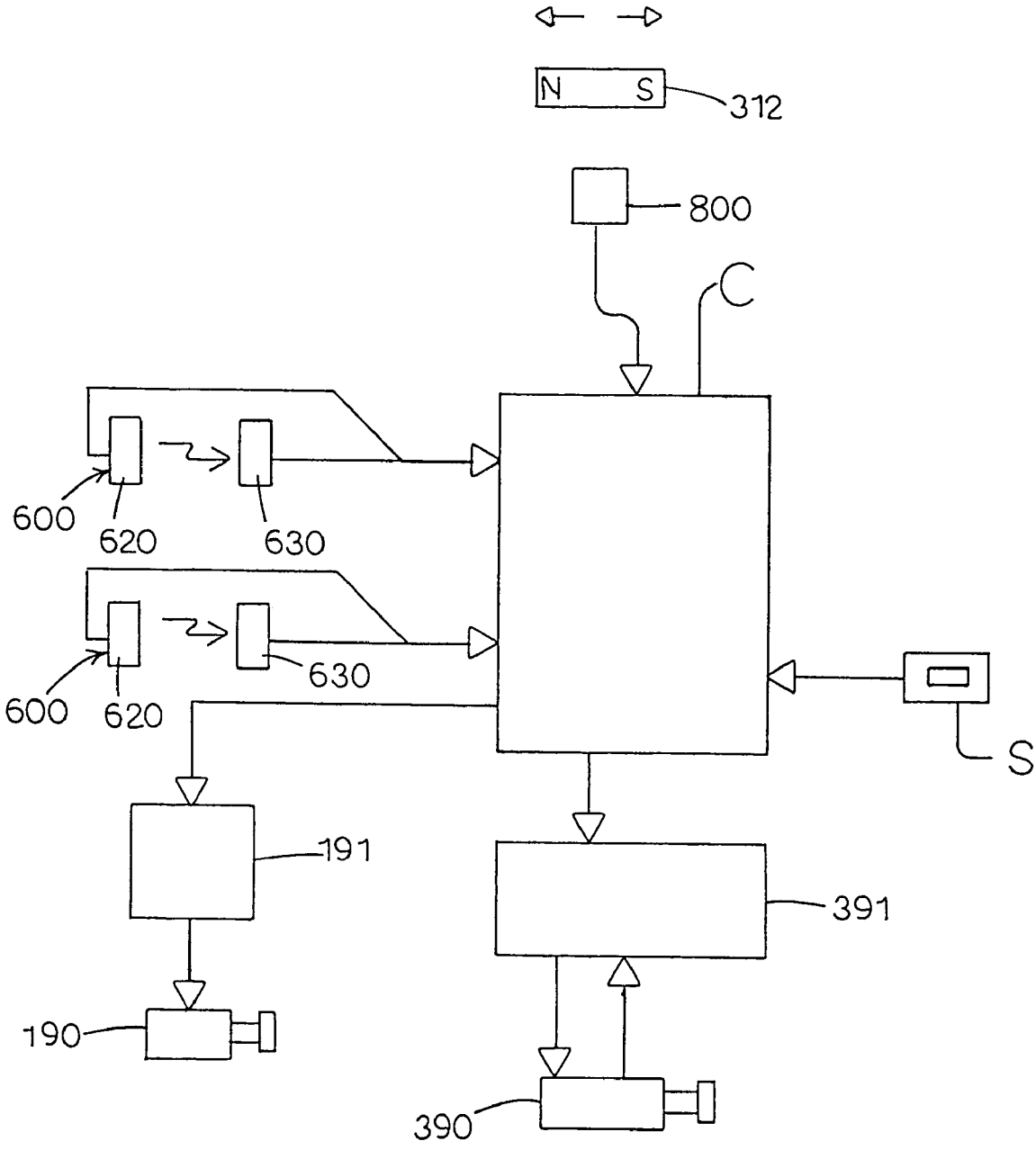
FIG. 1B is a schematic view of a control system for an exemplary embodiment of the sheet feeder according to the present invention.

Magazine 100 is generally conventional technology. It comprises a magazine table 105 over which one or more toothed high friction transport belts 110 span. Transport belts 110 have sheet material stacked on edge and held in that position by paddle 101 and are moved by a magazine motor 190 in the direction F of pressure roller subassembly 200 and feed subassembly 300. The magazine drive motor allows for transport belts 110 to operated at any of a number of speeds dependent upon the thickness of the on-edge sheet material stacked thereon and the rate with which feed subassembly 300 feeds those sheets out of magazine 100 so that sheets are constantly being supplied to the feed area for separation and feeding downstream. Magazine motor 190 is electronically connected to controller C through DC controller 191 to receive control signals from controller C (FIG. 1B).

Figure 4A:
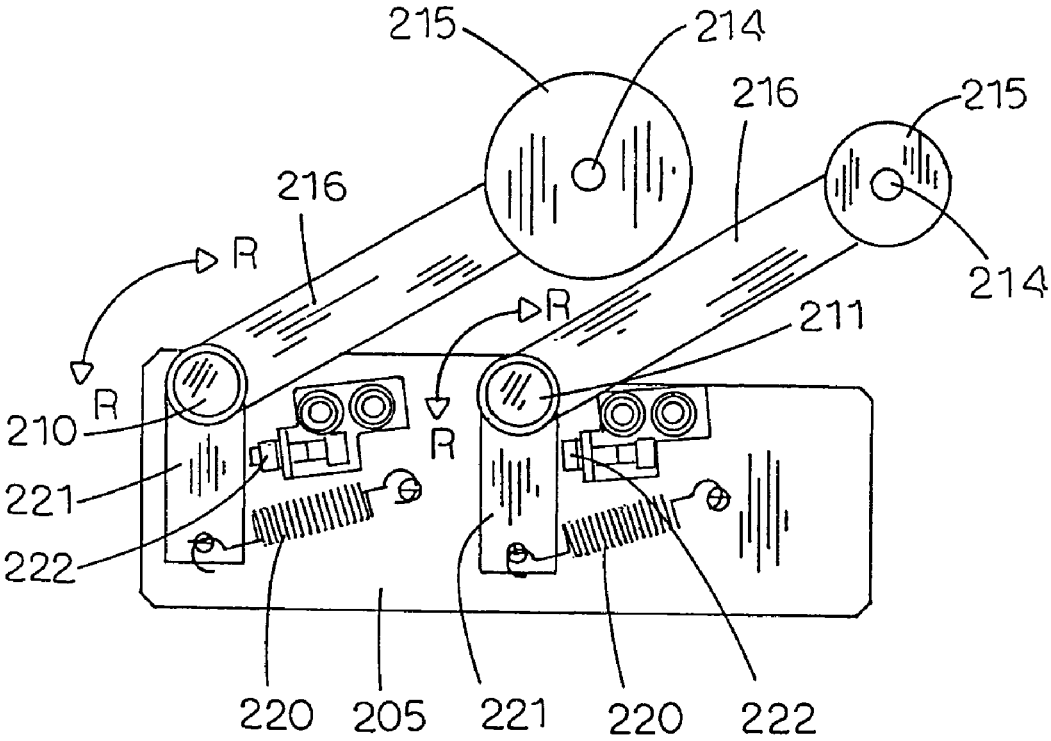
FIGS. 4A, 4B, are plan and elevation views, respectively, of an exemplary pressure roller mechanism for use with an exemplary embodiment of a sheet feeder according to the present invention.
Figure 4B:
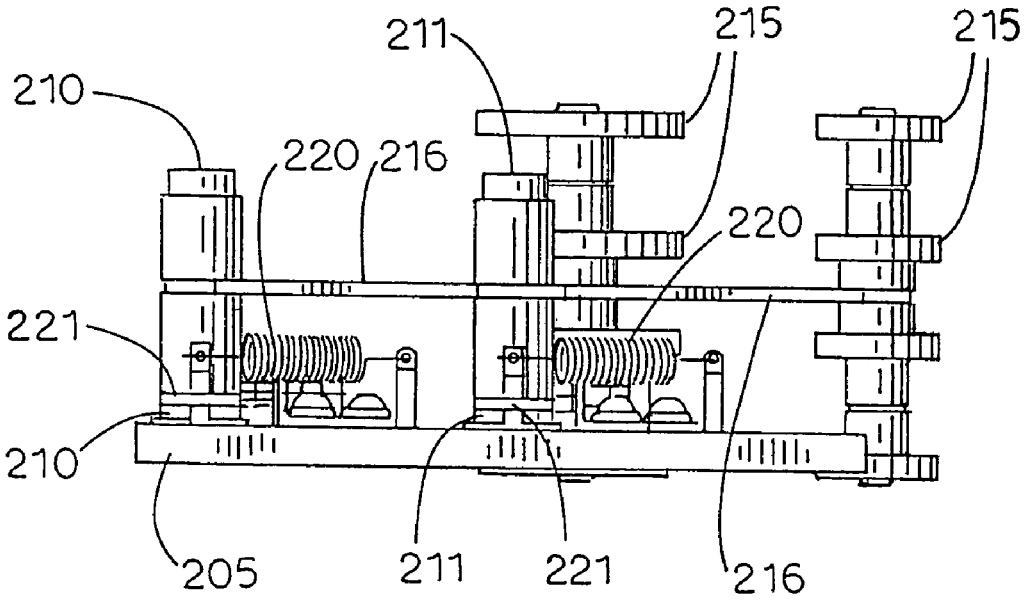

Pressure roller subassembly 200 is shown in FIGS. 4A, 4B and comprises base plate 205 which is attached to the housing (not shown) of the sheet feeder 1000. Axles 210, 211 vertically protrude from base plate 205. Rotating pressure rollers 215 are mounted to arms 216 through axles 214. Arms 216 are pivotally mounted to axles 210, 211 and rotate there around as depicted by the curved arrows R—R. Therefore, the position of rotatable pressure rollers 215 is variable due to the ability of arms 216 to pivot. Arms 216 each have an arm extension 221 attached thereto and pivotable therewith. Bias springs 220, attached at one end to arm extensions 221 and at the other end to base plate 205 are used to keep the arms 216 and rollers 215 in a naturally extended position, i.e., in a direction towards the sheet magazine 100. Therefore, the pressure of the sheet material being fed towards the pressure roller subassembly 200 and the feed subassembly 300 must overcome this bias to rotate the arms 216. Stops 222 limit the amount of pivoting of arms 216. Pressure roller subassembly 200 is used to apply a pressure to the sheet material for preventing the deflection and deformation of the sheets at their end opposite sheet feeder subassembly 300.

Figure 3A:
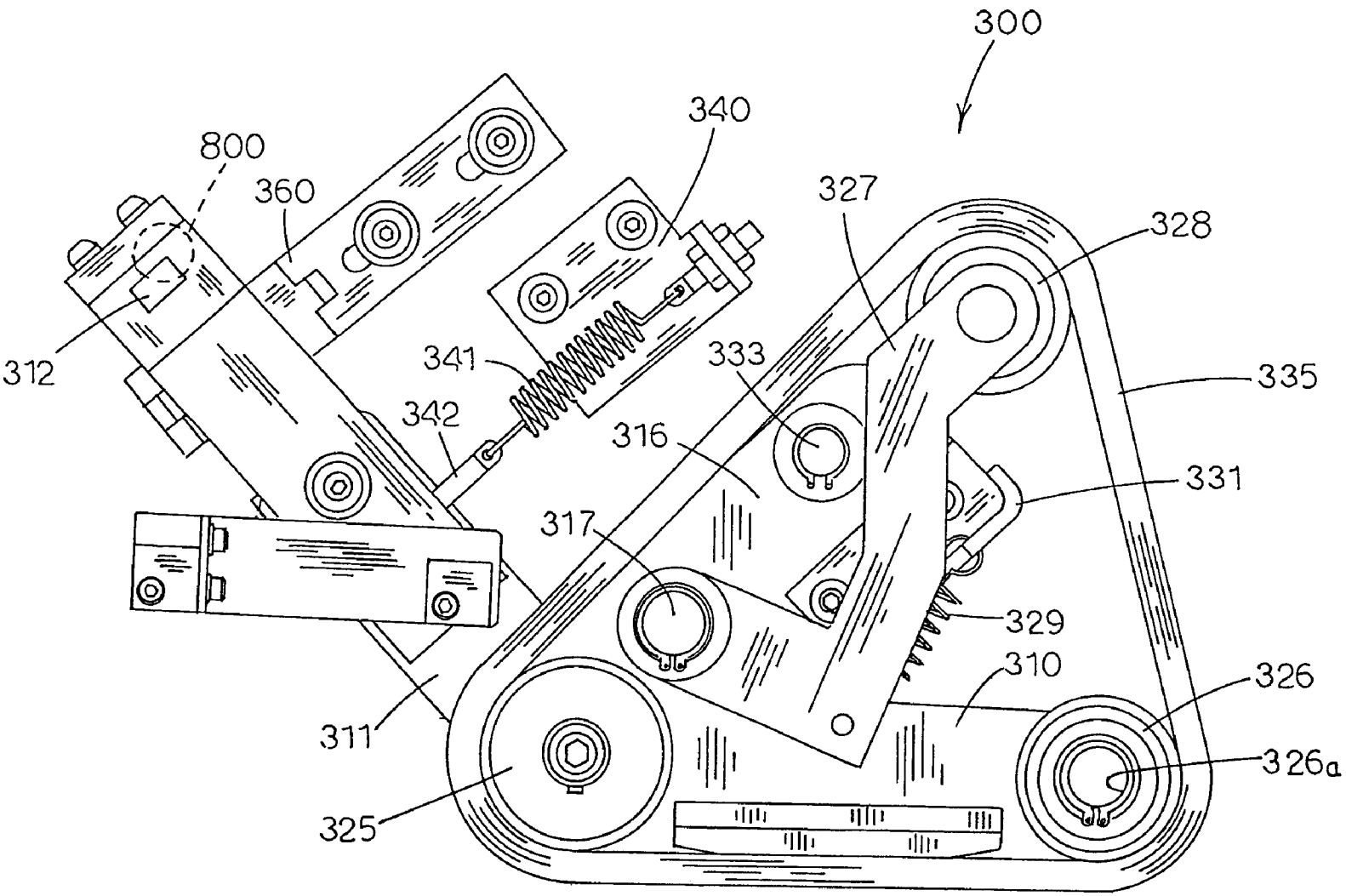
FIGS. 3A and 3B are plan and elevation views, respectively, of an exemplary feed belt mechanism for use with an exemplary embodiment of a sheet feeder according to the present invention.
Figure 3B:
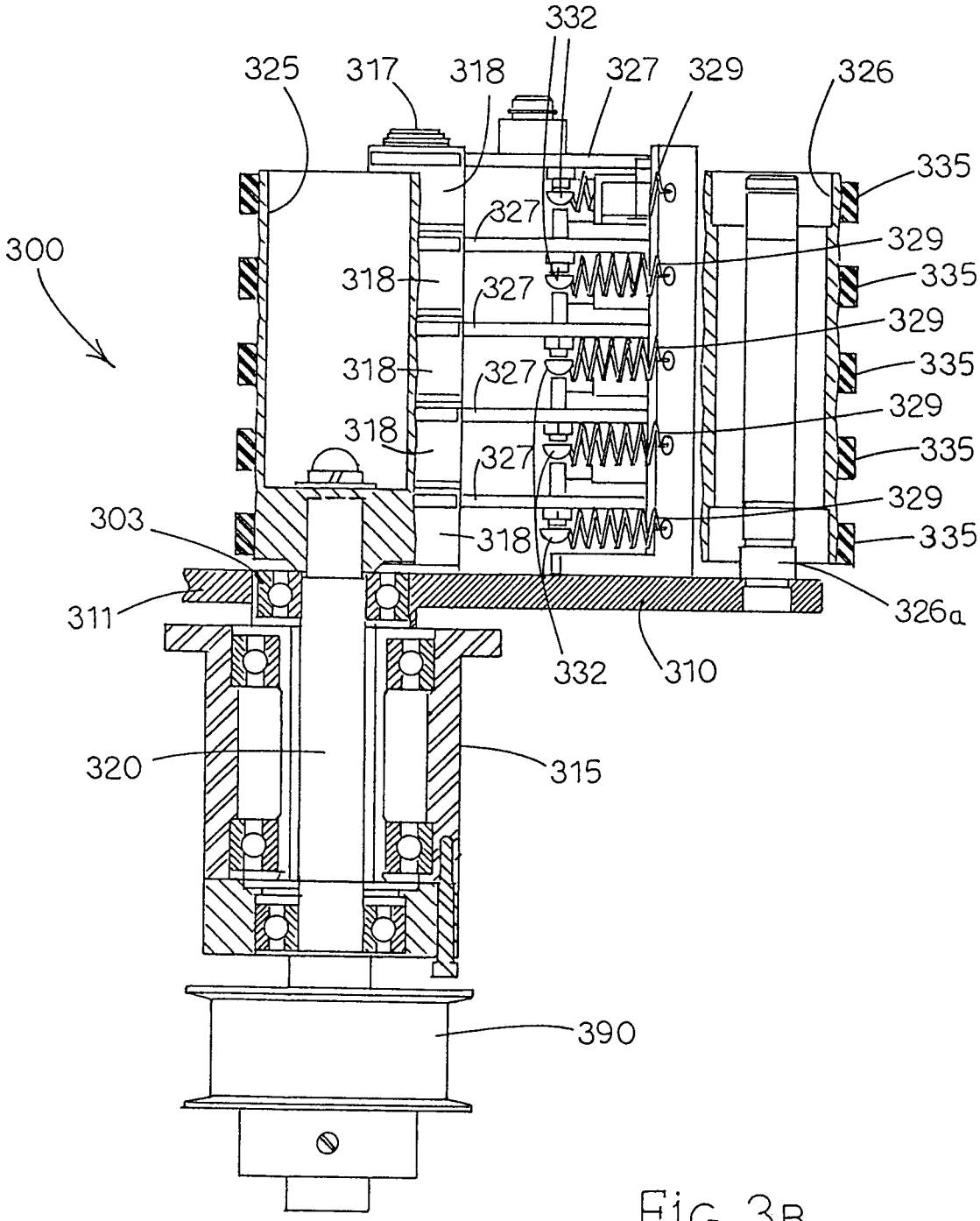

Feeder subassembly 300 is shown in FIGS. 3A–3B and supported by flat v-shaped lever arm 310. Positioned under v-shaped lever arm 310 and the sheet feeder table (not shown) is a bearing housing 315 out of which drive shaft 320 protrudes. Drive shaft 320 is attached to servo-drive motor 390 under v-shaped lever arm 310 and is also under the sheet feeder table (not shown) and inside the sheet feeder 1000. Shaft 320 protrudes through bearing 303 and the vertex of v-shaped lever arm 310. Via bearing 303, v-shaped lever arm 310 is rotatably mounted with respect to shaft 320 such that feed assembly 300 can pivot towards and away from the sheet path (arrow P—P in FIG. 1A). Drive pulley 325 is mounted to the other end of shaft 320 for rotation therewith. Attached to the end of one of the legs of v-shaped lever arm 310 is a shaft 326*a* supporting rotatably mounted idler pulley 326. Attached to the end of the other leg of v-shaped lever arm 310 is an extension arm 311 supporting a magnet 312 for use with a Hall-effect sensor assembly 800 mounted in the sheet feeder table and over which magnet 312 will pass. Hall-effect sensor 800 is electronically connected to controller C (FIG. 1B) such that as magnet 312 passes over sensor 800, the output voltage of sensor 800 changes. Controller C is able to record or measure these voltage changes and use them to determine the physical position of lever arm 311 between limit member 360 and therefore feeder 300, based upon the voltage emitted by Hall-effect sensor 800.

Extension leg 316 is rigidly attached to and extends out of v-shaped lever arm 310 and therefor rotates therewith. Extending vertically out of a hole at the free end of extension leg 316 is shaft 317. Alternately stacked on shaft 317 are spacer members 318 and pivoting idler arms 327. Pivoting idler arms 327 have rotating idler rollers 328 at the free end thereof. Drive belts 335 are wrapped around pulleys 325, 326, and 327. Springs 329, mounted at one end thereof to spring holder 331 of extension leg 316 and at the other end to spring connector 332 of pivoting idler arm 327 bias pivotally mounted idler arms 327 in an outward direction so as to keep belts 335 under the necessary tension as belts 335 begin to wear. Stop 333 is present in the event that any of belts 335 break, its pivotally mounted idler arm 327, which will then be freely deflected outward due to its associated spring 329, does not interfere with machine operation. Through this structure, servo-motor 390, through pulleys 325, 326, and 328, cause belts 335 to rotate at a lower speed varying between 20–70 inches per second (ips) or a higher speed of between 110 to 120 ips dependent upon sheet size as will be described below, such rotation being in the clockwise direction when the sheet feeder 1000 is configured as shown in FIG. 1A. Servo-motor 390 is electronically connected by servo-controller 391 (FIG. 1B) to controller C to receive control signals from controller C.

Rounding out feeder subassembly 300 is the structure for biasing pivotally mounted v-shaped lever arm 310 and its associated components towards the sheet path. This structure includes an expansion spring 341 mounted to a support bracket 340 at one end and a spring mount 342 at the other. Support bracket 340 is mounted to the sheet feeder table and spring mount 342 is mounted to v-shaped lever arm 310.

Figure 2A:
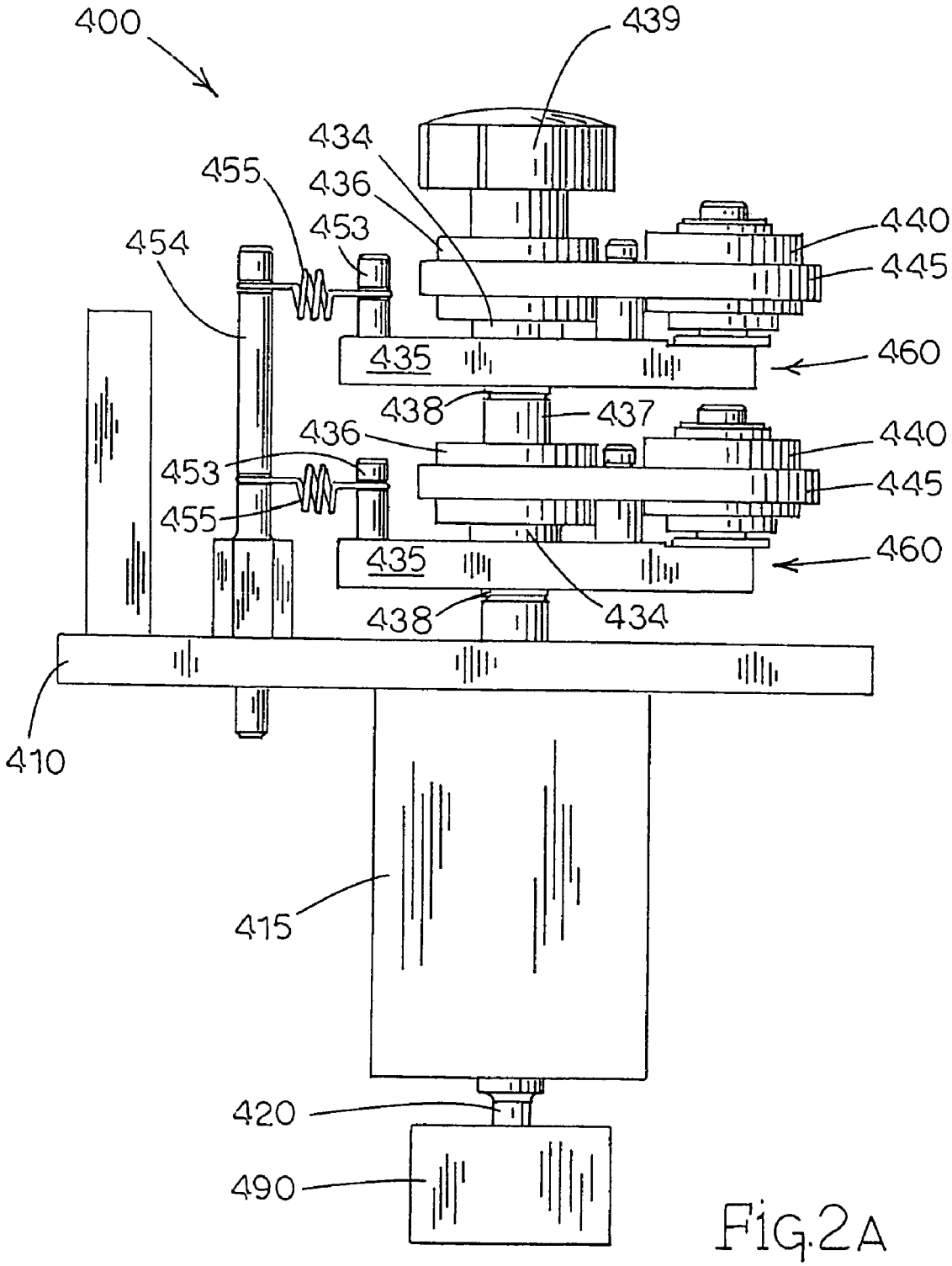
FIGS. 2A and 2B are elevation and plan views, respectively, of an exemplary singulator mechanism for use with an exemplary embodiment of a sheet feeder according to the present invention.
Figure 2B:
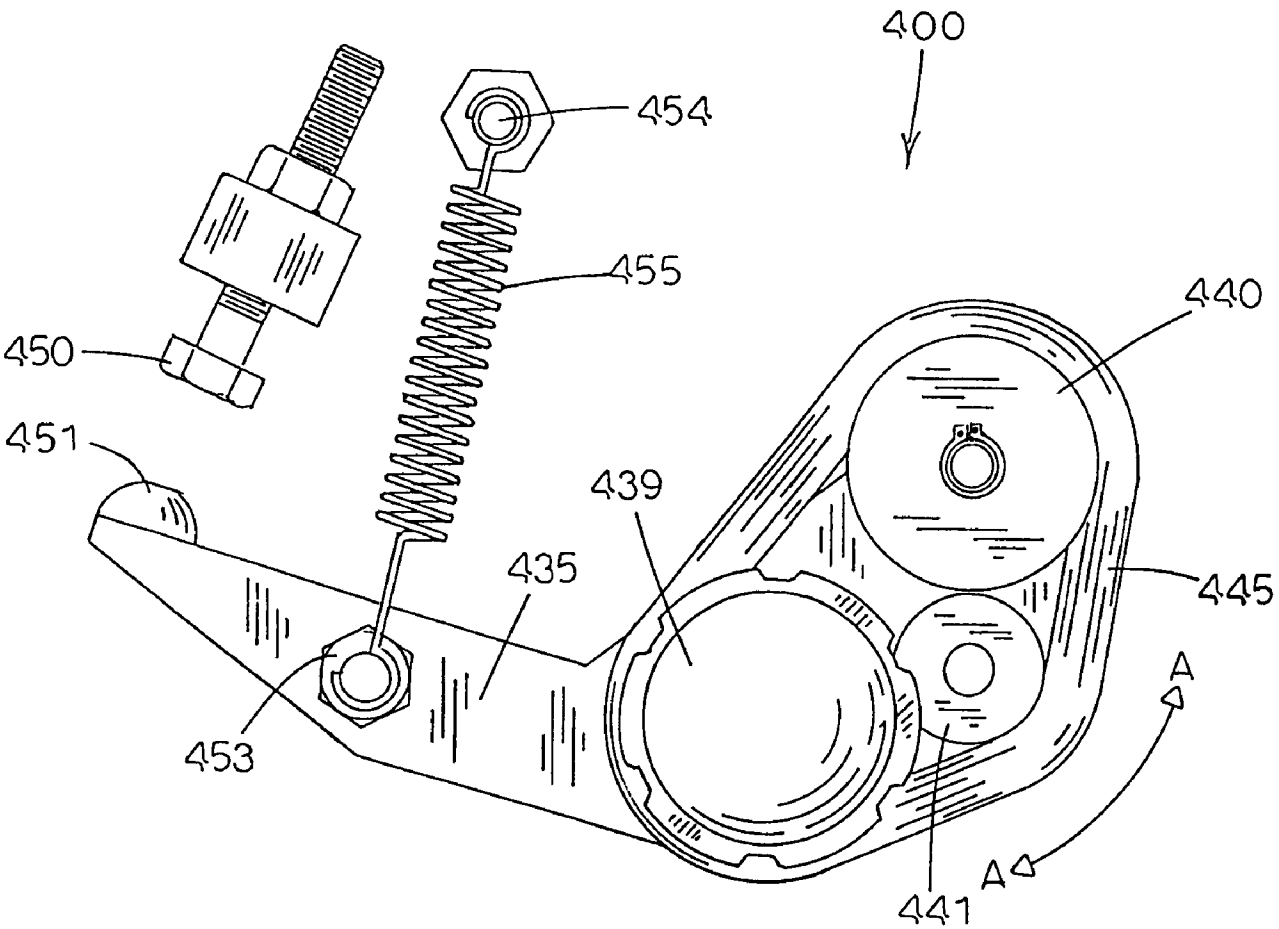

Singulator subassembly 400 is shown in FIGS. 2A–2B. Positioned under the sheet feed table 410 is a bearing housing 415 out of which shaft 420 protrudes. Shaft 420 is attached to drive motor 490 also positioned under sheet feeder table 410 and inside the sheet feeder 1000. For reasons to be discussed below, the upper portion of shaft 420 is non-circular in cross section above sheet feeder table 410.

Removably stacked on the upper portion of shaft 420 are one or more self-contained pre-constructed removable conveyor assemblies 460 hereinafter referred to as "removable conveyor assemblies". By "self-contained" and "preconstructed", applicants mean a single off-the-shelf part constructed as follows. Each removable conveyor subassembly 460 comprises a: singulator arm 435, singulator drive roller 436 attached via rotatable bearings 434 to singulator arm 435, spacers 437 that may or may not be integral with singulator drive rollers 436, rotatable singulator idler roller 440 attached via rotatable bearings (not shown) to singulator arm 435, rotatable singulator tension roller 441 attached via rotatable bearings (not shown) to singulator arm 435, and singulator belt 445 spanning singulator drive roller 436, singulator idler roller 440, and singulator tension roller 441. When completed, singulator belts 445 lie within the gaps between feed belts 335 and on opposite sides of the sheet path.

While singulator drive rollers 436 are removably mounted to shaft 420 but also mounted for rotation therewith, singulator arms 435 are removably mounted to shaft 420 using bearings 438 so that arms 435 may rotate relative to shaft 420. The removable mounts of removable conveyor assemblies 460 are achieved by having non-circular holes in arms 435 and rollers 436 that mate with the non-circular cross-section of shaft 420. Accordingly, when shaft 420 turns, drive rollers 436 rotate, while arms 435 do not. End cap 439 tops off shaft 420 and is screw-threaded thereto. End cap 439 secures the removable conveyor assemblies 460 to the shaft 420.

When motor 490 starts up with feeder assembly 300, drive roller(s) 436 will rotate, thereby rotating singulator belts 445. Singulator belts 445 are caused to rotate at a speed substantially slower than that of the feed belts 335 that they oppose. Singulator belts 445 rotate at about 0.5 ips (inches per second) and may rotate either in the same or opposite direction as feed belts 335.

As stated above, singulator arms 435 are mounted for relative movement with respect to shaft 420. This movement comprises pivoting in the direction of arrow A—A in FIG. 2B. To control the amount of pivoting, stop 450 is mounted to the sheet feeder table 410 and works in combination with bumper 451 mounted to the free end of singulator arms 435. Biasing pivoting singulator subassembly 400 towards feed subassembly 300 are springs 455. Springs 455 are connected to spring-arm connectors 453 on pivoting singulator arms 435 and spring-table connectors 454 on sorting table 410.

The structure described above allows for the easy maintenance of singulator 400 by a machine operator of no special skill rather than a specially trained service technician. If a belt 445 becomes worn, damaged, etc., or any other portion of singulator 400 needs to be replaced, it can be easily done by the machine operator. In particular, all the operator need do is: remove end cap 439 from shaft 420, remove the removable conveyor subassembly 460 with which the worn or damaged part is a component of, place a new removable conveyor subassembly 460 on the shaft 420, and replace the end cap 439. The time it takes to carry out this process is a mere fraction of the time it has taken in the past to deconstruct a less modular sheet feeder.

Sensor subassembly 600 is used for determining the length of sheets separated by sheet feeder 1000. Sensor subassembly 600 comprises a pair of spaced apart sensor elements, typically in the form of photo emitters 620 and receptors 630. Note that it is irrelevant as to which side of the sheet path the emitters 620 and receptors 630 are found and that the configuration shown in the preferred embodiment is a mere example. Receptors 630 will be hard wired to controller C such that an electronic signal can be sent to controller C by receptor 630 when the leading edge of the sheet is detected, i.e., by blocking the light beam and the receptor detecting as such. Controller C can calculate the sheet length by using signals and times corresponding to the blocking and unblocking of the various receptors.

Finally, mail transport subassembly 700 comprises opposed conveyor belts 710. These belts rotate at a constant speed of about 127 ips and in a direction that feeds separated sheets from the feeder subassembly 300 downstream towards the downstream operation, in this example, the optical reader and sorting stations.

Having described the structure of sheet feeder 1000, its method of control and operation will now be described.

A supply of on edge sheet material is placed onto belts of magazine 100. These sheets may comprise either pre-sorted (by size) mail or a mixture of mail of different sizes (e.g., post card and folded letter). These sheets may also be of differing thickness, ranging from very thin post card to thicker folded letter within an envelope. Dependent upon whether the magazine contains only postcard length material or postcard and/or letter length material, a switch S is positioned to the appropriate setting of "Card" or "Letter" as described above. The magazine motor 190 is started and the on edge stacked sheet material is fed towards pressure roller subassembly 200 and sheet feeder subassembly 300 at a speed dependent upon the setting of switch S, as described above.

As the on edge sheet material is fed towards pressure roller subassembly 200, servo-motor 390 of feeder assembly 300, singulator motor 490 and transport belts 700 are rotating at their operating speeds regardless of the setting of switch S.

Upon entry of stacked sheet material into feeder assembly 300, controller C "holds" the following piece for a selectable predetermined duration/period of time to create a controlled gap prior to "releasing" the following piece into the transport stream. Note that "hold" here implies the lower belt speed of 20–70 ips, while "releasing" implies the higher speed of 110–120 ips. If, for example, a short (less than 6" long) is seen by controller C, a greater "hold" time would apply, thereby creating a greater gap between mail pieces. Switch S, when in "card" setting, will cause motor 190 to run at a much slower speed then when in "letters" setting. In either case, when the sheet material enters transport subassembly 700, it is moved at the high speed regardless of its length. However, the difference in sheet feed subassembly 300 feed speeds for the two sheet material sizes is critical because of the operation of a downstream optical reader (not shown), such as for reading bar code material off of a sheet. The maximum number of objects which can be read by the standard reader per unit time and at the approximately 127 ips feed speed of transport subassembly 700 is a fixed number. For sheet length material, this number of objects per unit time corresponds to sheets being fed to transport subassembly 700 at a fixed speed. If the shorter postcard material is fed at this same fixed speed, more objects per unit time will enter transport subassembly 700 and pass the reader and thus exceed the read rate of the reader. This is not acceptable so, if shorter postcard material is present, the next piece of sheet material is fed out to transport subassembly 700 at a larger spacing between the sheet material.

As the lead sheet comes into contact with pressure roller subassembly 200 and feed belt 335 of feeder 300, the few pieces immediately after the lead sheet begin to slowly fan out due to frictional forces between the sheets, the action of sheet feed subassembly 300, the relatively slow speed of singulator belts 445, and the coefficient of friction of singulator belts 445. Furthermore, during this preliminary feed, feed subassembly 300 and singulator subassembly 400, operate against the biases of their respective springs 341 and 436 to move towards each other and form a sheet path whose size is self-adjustable on the fly.

The lead sheet of magazine 100 then comes into full contact with feed belts 335 of feeder 300. The sheet is then fed downstream by belts 335 and through photo sensor subassembly 600 where sensors 620*a*, 620*b* emit signals to controller C based upon the detection of the edges of the sheet. Using these signals and a built-in timer, controller C uses conventional programming/technology to determine the length of the just fed sheet and generating a signal representative thereof.

The speed of motor 390 and therefore belts 335 are varied to slow down or speed up pieces in order to create controlled length gaps. If the fed sheet was larger, e.g., letter size, the mail piece is held for a fixed time at the lower speed before being released to transport assembly 700 at the higher speed. If the fed sheet was smaller, e.g., postcard size, the piece is held for a longer fixed time at the lower speed before being released to transport assembly 700 at the higher speed. Once again, the lower speed constitutes a speed of 20–70 ips, while the faster speed constitutes a speed of 110–120 ips. Both fixed times mentioned above (for letters or cards) are selectable by controller C. This will increase the gap size between the fed sheet and the next fed sheet to a size such that only a predetermined number of sheets pass the optical reader per given unit of time.

When letters are run, the length of regular mailpieces (averaged out) with the smallest setting gap combine to produce a throughput that never exceeds the capability of the optical reader.

When cards are run, the throughput is much higher and has the potential to exceed the capability of the optical reader due to the shorter length of cards (less than 6 inches). Therefore the extra gap is added for cards to address this potential problem.

As sheets are fed out of the feed area by sheet feed subassembly 300, the pressure that is exerted on belt 335 of feeder subassembly 300 decreases due to the depletion of sheet material from the feed path area between feed belts 335 and singulator belts 445. The decreased pressure on belt 335 causes the amount by which feeder subassembly 300 is pivoted out away from the mail path to change. This change in pivoting causes the relative position between the magnet 312 and the Hall-effect sensor 800 to change, thereby changing the output voltage of the Hall-effect sensor 313. Due to the difference in thickness between thick and thin sheets, as thicker sheets are fed, there is a greater change in the amount of pivoting of feeder subassembly 300, then there is when thinner sheets are fed. This difference in amounts of change in the pivoting results in different voltages being output to controller C by the Hall-effect sensor 800 dependent upon the type of sheets fed.

As sheets are fed out of the feed area, they need to be replenished so that the feeding may continue uninterrupted. Controller C controls this replenishment process as follows. Controller C receives a signal from Hall-effect sensor 800 indicative of the amount of pivoting of the feeder subassembly 300 the degree to which the feed area has been cleared by the feeding of sheets by feed subassembly 300.

Upon controller C receiving the signal from Hall-effect sensor 800 that the feed area is relatively empty, controller C sends a signal to the magazine motor 190 which causes the magazine motor 190 to operate at a faster speed. Accordingly, magazine belts are moved faster and sheets are quickly brought into the feed area for further processing downstream.

On the other hand, upon controller C receiving the signal from Hall-effect sensor 800 that the feed area is still somewhat full but slowly emptying (i.e., when feeding card material), controller C sends a signal to the magazine motor 190 which causes the magazine motor 190 to operate at a slower speed. Accordingly, magazine belts are moved slower and sheets are slowly brought into the feed area for further processing downstream.

Controller C and the magazine motor assure that sheets are always in the feed area ready for separation from the rest of the sheets. Feed subassembly 300 then separates the first sheet and it is fed to mail transport belts 700 and then downstream for the reading of optical characters there off and then for further processing, such as sorting.

The above description is given with reference to a sheet feeder apparatus and method. However, it will be understood that various details of the invention may be changed without departing from the scope of the invention. Furthermore, the foregoing description is for purpose of illustration only, and not for purpose of limitation, as the invention is defined by the following, appended claims.

What is claimed is:

1. A sheet feeder apparatus for feeding a supply of sheets of differing lengths during a feed run to a transport assembly, the sheet feeder apparatus comprising:

a feed subassembly having a contiguous conveyor with a variable speed drive source, the feed subassembly sequentially feeding sheets from said supply of sheets of differing lengths to the transport assembly;

a sensor subassembly for sensing sheets fed by the feed subassembly to the transport assembly; and a control system in communication with the feed subassembly and the sensor subassembly, wherein:

said control system determines a length of each successive sheet from the supply of sheets of differing lengths using signals received from the sensor subassembly and varies the speed of the conveyor dependent upon the determined length of each successive sheet, thereby selectively changing the size of a gap between successive sheets being fed to the transport assembly, the supply of sheets includes sheets of at least a longer length and a shorter length relative to each other, and the entire contiguous conveyor selectively operates at least at one of a constant lower speed and a constant higher speed as each successive sheet is being fed, each successive sheet from the supply of sheets is fed by the conveyor at the lower speed for a period of time, and thereafter at the higher speed, to create the gap between successive sheets, and the control system increases said period of time upon detection of a sheet having the shorter length, thereby increasing the size of the gap between successive sheets.

2. The sheet feeder apparatus of claim 1, further comprising a magazine subassembly, wherein the supply of sheets is supported by the magazine subassembly, proximate the feed subassembly, wherein the supply of sheets is fed by the magazine subassembly to the feed subassembly via a magazine motor.

3. The sheet feeder apparatus of claim 2, further comprising a singulator subassembly, wherein successive sheets are separated from the supply of sheets by the singulator subassembly, in conjunction with the feed subassembly.

4. A sheet feeder apparatus for feeding a supply of sheets of differing lengths during a feed run from a magazine assembly to a transport assembly, the sheet feeder apparatus comprising:

a feeder assembly having a variable speed drive source, the feeder assembly sequentially feeding sheets from the magazine assembly to the transport assembly;

a sensor assembly for sensing sheets as the sheets move from the magazine assembly, to the transport assembly; and a control system in communication with the feeder assembly and the sensor assembly, wherein:

the control system determines a length of each successive sheet from the supply of sheets of differing lengths using signals received from the sensor assembly and varies the speed of said feed subassembly dependent upon the determined length of each successive sheet, thereby selectively changing the size of a gap between successive sheets being fed from the magazine assembly to the transport assembly, each successive sheet from the supply of sheets is fed by the entire contiguous feeder assembly at a constant lower speed for a period of time, and thereafter fed by the entire contiguous feeder assembly at a higher speed, to control the gap between successive sheets, and the control system selectively determines the period of time dependent upon the determined length of each successive sheet.

5. The sheet feeder apparatus of claim 4, wherein the supply of sheets includes sheets of at least a longer length and a shorter length relative to each other, and wherein the control system increases the period of time upon detection of a sheet having the shorter length, thereby increasing the size of the gap between successive sheets.

6. The sheet feeder apparatus of claim 4, further comprising a singulator assembly, wherein successive sheets are separated from the supply of sheets by the singulator assembly, in conjunction with the feeder assembly.

7. The sheet feeder apparatus of claim 1, wherein the sensor subassembly comprises a first sensor and a second sensor.

8. The sheet feeder apparatus of claim 7, wherein the first sensor is located proximate an end of the conveyor.

9. The sheet feeder apparatus of claim 7, wherein the second sensor is located proximate an entrance to the transport assembly.

10. The sheet feeder apparatus of claim 1, wherein the feed subassembly feeds successive sheets directly to the transport assembly.

11. The sheet feeder apparatus of claim 1, wherein the lower speed is in the range of 20–70 ips.

12. The sheet feeder apparatus of claim 1, wherein the higher speed is in the range of 110–120 ips.

13. The sheet feeder apparatus of claim 3, wherein a supply detection sensor is operatively connected to the control system, and wherein the supply detection sensor senses sheets between the singulator subassembly and the feed subassembly, and the control system controls the speed at which the magazine subassembly feeds the supply of sheets to the feed subassembly using signals received from the supply detection sensor.

14. The sheet feeder apparatus of claim 4, wherein the sensor assembly comprises a first sensor and a second sensor.

15. The sheet feeder apparatus of claim 14, wherein the first sensor is located proximate an end of the feeder assembly.

16. The sheet feeder apparatus of claim 14, wherein the second sensor is located proximate an entrance to the transport assembly.

17. The sheet feeder apparatus of claim 4, wherein the feeder assembly feeds successive sheets directly to the transport assembly.

18. The sheet feeder apparatus of claim 4, wherein the lower speed is in the range of 20–70 ips.

19. The sheet feeder apparatus of claim 4, wherein the higher speed is in the range of 110–120 ips.

* * * * *

UNITED STATES PATENT AND TRADEMARK OFFICE

CERTIFICATE OF CORRECTION

PATENT NO. : 7,168,700 B2
APPLICATION NO. : 10/683254
DATED : January 30, 2007
INVENTOR(S) : Herman G. Skadow et al.

It is certified that error appears in the above-identified patent and that said Letters Patent is hereby corrected as shown below:

On the Title Page of the Letters Patent and page 1 of the specification;

On the Title Page, under Section (22) insert:

--(62) Related U.S. Application Data

Division of application No. 10/072,791, filed on Feb. 8, 2002, now Pat. No. 6,644,659; which is a divisional of application No. 09/237,214, filed on Jan. 25, 1999, now Pat. No. 6,354,583--

And

On page 1 of the specification Column 1, line 3; before "Technical Field" insert;

--RELATED APPLICATION DATA

This application is a divisional of U.S. Application 10/072,791, filed on February 8, 2002, now U.S. Patent 6,644,659; which is a divisional of U.S. Application 09/237,214, filed on January 25, 1999, now U.S. Patent 6,354,583.--

Signed and Sealed this
Seventeenth Day of January, 2012

David J. Kappos

David J. Kappos
*Director of the United States Patent and Trademark Office*